US007841908B2

(12) United States Patent
Shen et al.

(10) Patent No.: US 7,841,908 B2
(45) Date of Patent: Nov. 30, 2010

(54) ELECTRICAL CONNECTOR HAVING AN IMPROVED HOUSING HAVING A CURVED STRUCTURE

(75) Inventors: Hui-Juan Shen, Kunshan (CN); Qing Wan, Kunshan (CN); She-Min Cai, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 60 days.

(21) Appl. No.: 12/284,392

(22) Filed: Sep. 22, 2008

(65) Prior Publication Data

US 2009/0081907 A1 Mar. 26, 2009

(30) Foreign Application Priority Data

Sep. 22, 2007 (CN) ..... 2007 2 0044126

(51) Int. Cl.
*H01R 24/00* (2006.01)

(52) U.S. Cl. ..... 439/676

(58) Field of Classification Search ..... 439/676, 439/620.11, 620.17, 620.18, 620.23, 541.5
See application file for complete search history.

(56) References Cited

U.S. PATENT DOCUMENTS 5,310,360 A * 5/1994 Peterson ..... 439/571
5,697,817 A * 12/1997 Bouchan et al. ..... 439/676
6,022,245 A * 2/2000 Minich ..... 439/620.17
6,176,742 B1 * 1/2001 Arnett et al. ..... 439/620.23
6,257,935 B1 * 7/2001 Zhang et al. ..... 439/680
6,368,160 B2 * 4/2002 Chang ..... 439/676
6,402,563 B1 * 6/2002 Shi et al. ..... 439/676
6,416,364 B1 * 7/2002 Shi et al. ..... 439/680
6,497,588 B1 * 12/2002 Scharf et al. ..... 439/607.38
6,554,638 B1 * 4/2003 Hess et al. ..... 439/490
6,579,128 B1 * 6/2003 Wu ..... 439/676
7,314,387 B1 * 1/2008 Liu et al. ..... 439/620.11
7,591,688 B2 * 9/2009 Wang ..... 439/676
7,637,780 B2 * 12/2009 Schoene et al. ..... 439/620.11
2009/0258545 A1 * 10/2009 Pepe et al. ..... 439/676

* cited by examiner

*Primary Examiner*—Neil Abrams
*Assistant Examiner*—Harshad C Patel
(74) *Attorney, Agent, or Firm*—Ming Chieh Chang; Wei Te Chung; Andrew C. Cheng

(57) ABSTRACT

An electrical connector (1) for electrically connecting with a modular plug (2) includes an insulative housing (10) having a receiving cavity (100) and a resisting block (126) formed in the receiving cavity and having a curved surface (122). A number of contacts (20) is mounted in the receiving cavity. Each contact has a mating portion (21) extending into the receiving cavity and cantilevered above the resisting block. The modular plug is engaged with the mating portion and presses the mating portion to the resisting block when the modular plug is inserted into the receiving cavity. When the plug connector is inserted into the receiving cavity, the mating potion abuts against the curved surface.

1 Claim, 4 Drawing Sheets

ELECTRICAL CONNECTOR HAVING AN IMPROVED HOUSING HAVING A CURVED STRUCTURE

BACKGROUND OF THE INVENTION

1. Field of the Invention

The present invention relates to the art of an electrical connector, and particularly to an electrical connector has an insulative housing having a curved structure for avoiding contacts having an excessive deformation under pressing force provided by a modular plug.

2. Description of Prior Arts

An electrical connector is disclosed in U.S. Pat. No. 5,310,360 issued on May 10, 1994. The electrical connector includes an insulative housing and a plurality of contacts mounted on the insulative housing. The insulative housing has a top wall, a bottom wall, and opposite lateral walls, and a receiving cavity defined therebetween for receiving a modular plug. Each contact includes a mating portion extending into the cavity and cantilevered below the top wall, a fastening portion mounted in a top wall and an intermediate arc portion interconnected with the mating portion and the fastening portion. The modular plug is engaged with the mating portion and presses the mating portion to the top wall when the modular plug is inserted into the cavity.

However, a pressing force provided by the modular plug is concentrated on the intermediate arc portion of the contact when the modular plug is inserted into the cavity. Thus the intermediate arc portion is deformable and the contact would have a decreased elasticity. In addition, modular plugs of different precision may be engaged with the mating portion of the contact of different position, it would result in the contact having an excessive deformation under the dispersed pressing force. And it is difficult to realize a reliable engagement between the electrical connector and different modular plugs.

Hence, it is desirable to provide an improved electrical connector to overcome the aforementioned disadvantages.

SUMMARY OF THE INVENTION

An object of the present invention is to provide an electrical connector having an insulative housing having a curved structure for avoiding contacts having an excessive deformation under a pressing force provided by a modular plug.

To achieve the above object, an electrical connector for electrically connecting with a modular plug includes an insulative housing having a receiving cavity and a resisting block formed in the receiving cavity, the resisting block having a curved surface. A number of contacts mounted in the receiving cavity. Each contact having a fastening portion fastened in the insulative housing, a mating portion extending into the receiving cavity and cantilevered above the resisting block. The modular plug is engaged with the mating portion and presses the mating portion to the resisting block when the modular plug is inserted into the receiving cavity. Wherein, when the modular plug is inserted into the receiving cavity of the insulative housing, the mating potion abuts against the curved surface.

During assembly, a pressing force provided by the modular plug is distributed equally along the mating portion of the contact, rather than concentrated on a certain portion of the mating portion. The contact could be protected since it is hard to having an excessive deformation under the dispersed pressing force. In addition, the engagement between the contact and the modular plug is therefore reliable.

Other objects, advantages and novel features of the invention will become more apparent from the following detailed description of the present embodiment when taken in conjunction with the accompanying drawings.

BRIEF DESCRIPTION OF THE DRAWING

FIG. 3 is a cross-sectional view of the electrical connector mounting on the outer printed circuit board with a modular plug inserted in.

DETAILED DESCRIPTION OF THE PREFERRED EMBODIMENT

Figure 1:
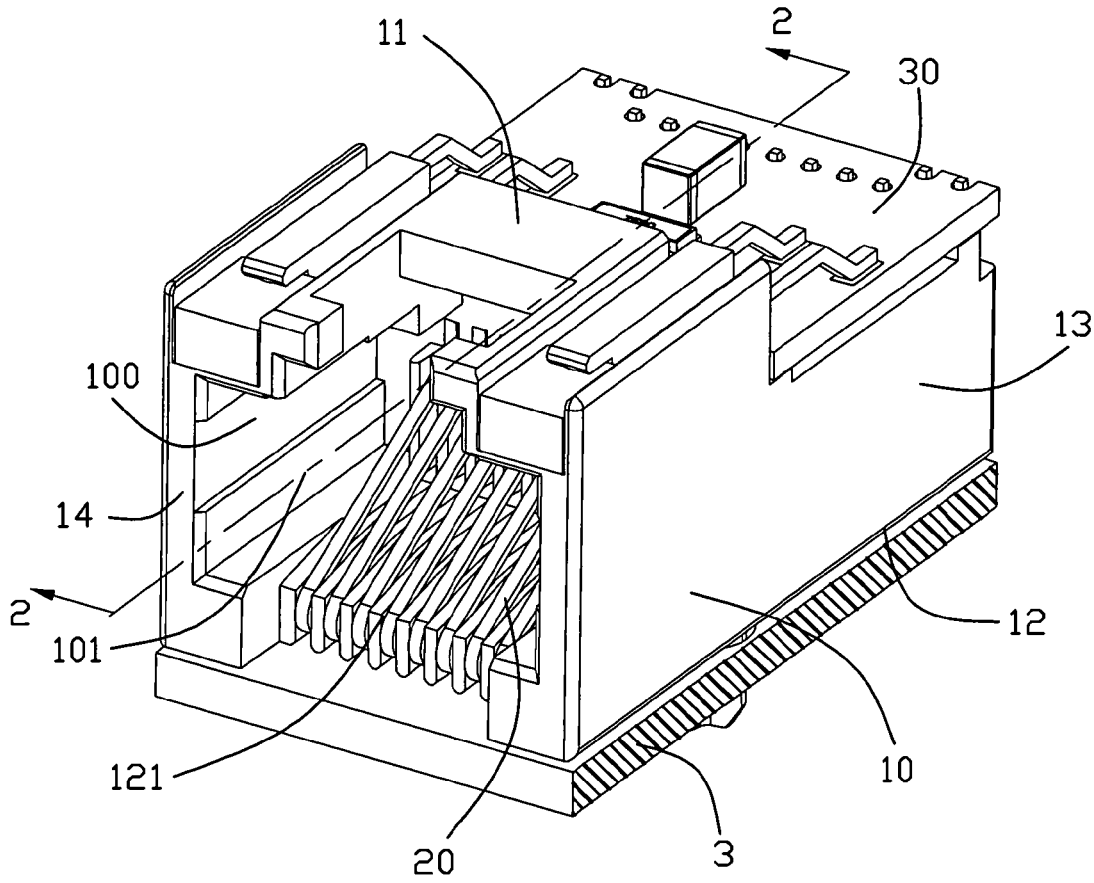
FIG. 1 is an assembled perspective view of an electrical connector mounting on an outer printed circuit board according to the present invention.
Figure 2:
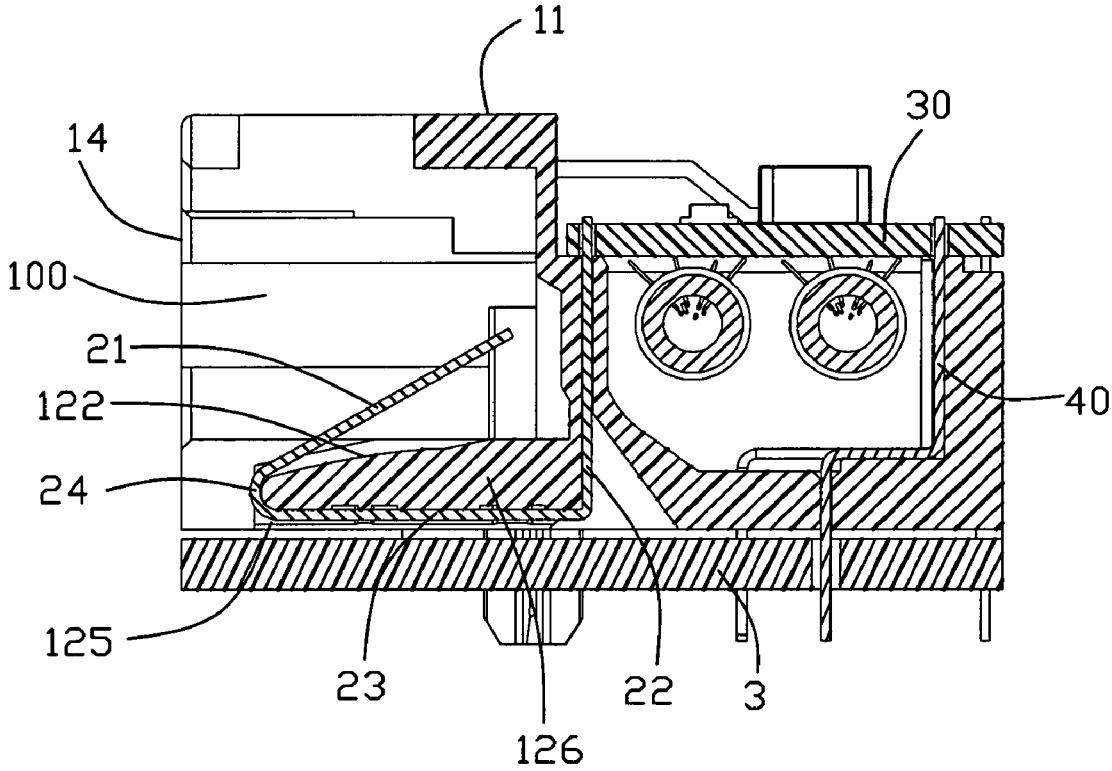
FIG. 2 is a cross-sectional view of the electrical connector mounting on the outer printed circuit board taken along the line 2-2 as shown in FIG. 1.
Figure 3:
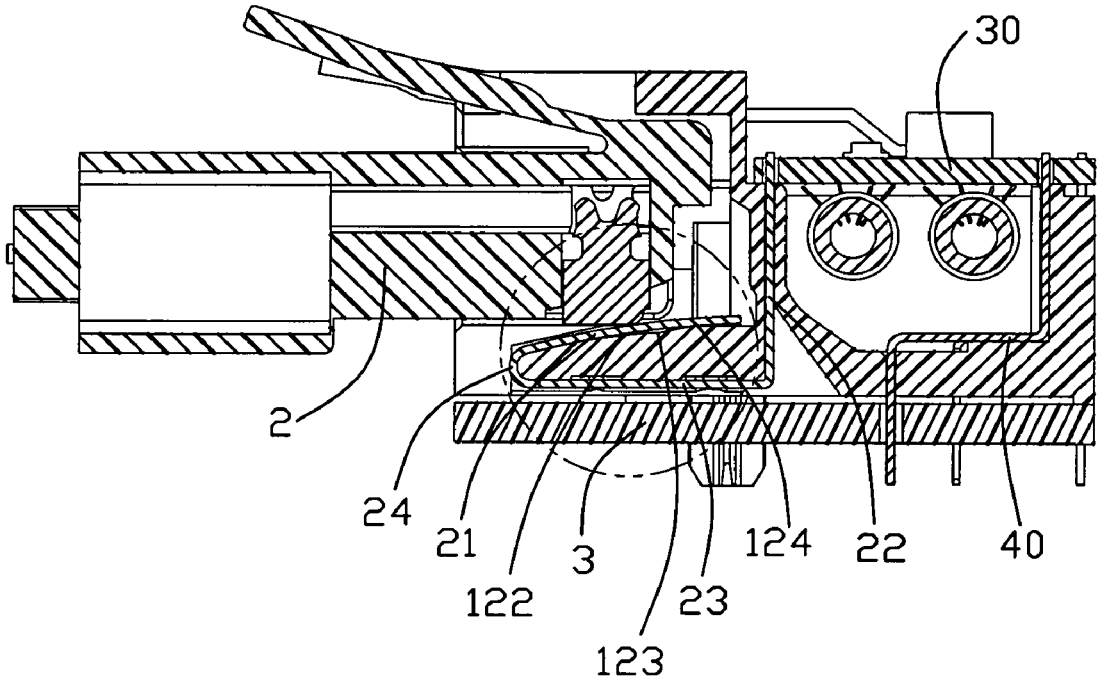
Figure 4:
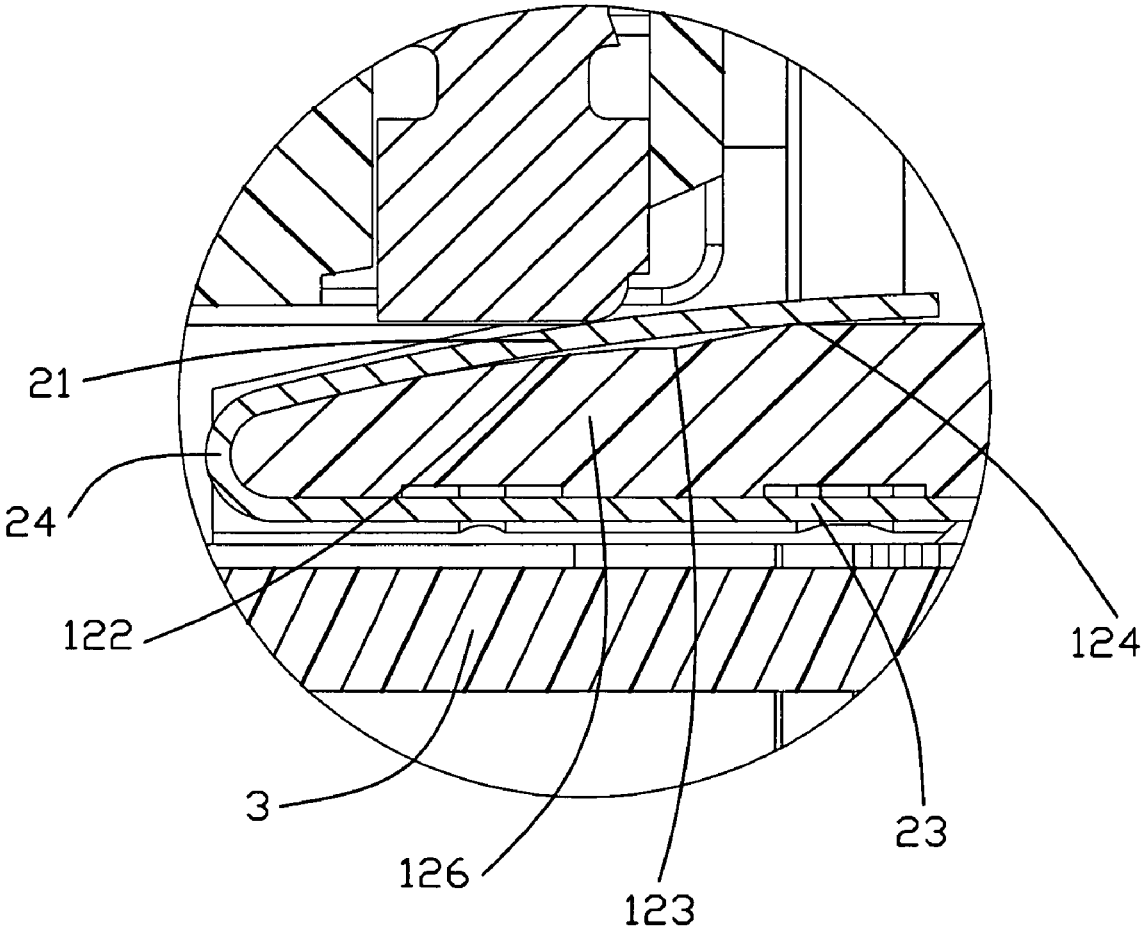
FIG. 4 is a magnifying view showing a mating portion of a contact abutting against a resisting block of the electrical connector when the modular plug is inserted in, as especially labeled in FIG. 3.

Reference will now be made to the drawing figures to describe the present invention in detail. FIGS. 1-4 show an electrical connector 1 electrically connecting a modular plug 2 with an outer printed circuit board 3. The electrical connector 1 includes an insulative housing 10, a plurality of contacts 20 mounted in the insulative housing 10, an inner printed circuit board 30 electrically connected with the contacts 20, and a plurality of transferring contact 40 electrically connected the electrical connector 1 with the outer printed circuit board 3.

Referring to FIGS. 1-4, the insulative housing 10 of a substantially rectangular shape has a top wall 11, a bottom wall 12, opposite lateral walls 13 and a receiving cavity 100 defined therebetween. The insulative housing 10 also has a mating face 14 defining an opening 101. The bottom wall 12 has a plurality of passages 121 defined on an upper surface thereof. Each receiving passages 121 has an inner bottom surface (not labeled) having a curved surface 122 disposed at a front portion, a supporting portion 124 disposed at a rear portion and a concave portion 123 disposed between the curved surface 122 and the supporting portion 124. The bottom wall 12 also has a plurality of securing passages 125 defined on a lower surface thereof.

A plurality of contacts 20 are mounted in the receiving cavity 100. Each contact 20 includes a mating portion 21 disposed at one end, a tail portion 22 disposed at an opposite end and a fastening portion 23 formed therebetween. The mating portion 21 is connected with the fastening portion 23 via an U-shaped intermediate arc portion 24. The mating portion 21 extends diagonally into the receiving cavity 100 for engaging with the modular plug 2. The tail potion 22 is disposed perpendicular to the inner printed circuit board 30 and has an end for electrically connecting with the inner printed circuit board 30. The fastening portion 23 is fastened in the securing passages 125.

The curved surface 122 and the concave portion 123 and the supporting portion 124 are formed as a resisting block 126. The fastening portion 23 of the contact 20 is disposed at a bottom surface of the resisting block 126. The U-shaped intermediate arc portion 24 is disposed around a front end of the resisting block 126. The mating portion 21 of the contact 20 is cantilevered above the resisting block 126. The curved surface 122 is bulgy towards the mating portion 21 of the contact 20.

When the modular plug 2 is inserted into the receiving cavity 100, the modular plug 2 is engaged with the mating portion 21, and the modular plug 2 presses the mating portion 21 bent to the resisting block 126. The mating portion 21 has a lower surface (not labeled) abutting against the curved surface 122 of the resisting block 126. And the mating portion has a free end (not labeled) abutting against the supporting portion 124. When the plug connector 2 is inserted into the receiving cavity 100 of the electrical connector 1, a gap (not labeled) is defined between the concave portion 123 and the mating portion 21 of the contact 20 for allowing a deformation of the mating portion 21 when the contact 20 is resisted against by the resisting block 126. In another embodiment, the curved surface 122, or the curved surface 122 and the concave portion 123 is or are formed as a resisting block 126. The mating portion 21 has a free end cantilevered above the resisting block 126 when the modular plug 3 is inserted into the receiving cavity 100.

When the modular plug 2 is inserted into the receiving cavity 100 of the insulative housing 10, the mating portion 21 of the contact 20 is bent towards the resisting block 126, with a lower surface of the mating portion 21 attached along the curved surface 122 of the resisting block 126. Thus, a pressing force provided by the modular plug 2 is distributed equally along the mating portion 21, rather than concentrated on a certain portion of the mating portion 21. The contact 20 could be protected since it is hard to have an excessive deformation under the dispersed pressing force. In addition, the engagement between the contact 20 and the modular plug 2 is therefore reliable.

Other objects, advantages and novel features of the invention will become more apparent from the following detailed description of a preferred embodiment when taken in conjunction with the accompanying drawings.

What is claimed is:

1. An electrical connector comprising:

an insulative housing including a mating cavity therein with a resisting block on one lateral face of said mating cavity; and a plurality of contacts dispose in the housing with contacting sections extending rearwardly from a front end region of the resisting block into the mating cavity in a cantilever manner; wherein said resisting block defines a concave surface behind a front end region below the contacting sections under a condition that the concave surface is fully open to the mating cavity when no plug is inserted into the mating cavity wherein said contacting section extends in a cantilevered manner, while being partially covered by the contacting sections when the plug is inserted into the mating cavity wherein a free end region of the contacting section is seated upon the resisting block at a first position right behind the concave surface and a root section of the contacting section is seated upon the resisting block at a second position right in front of the concave surface with the concave surface being spaced from the contacting section so as to have said contacting section extend in a simple supported manner rather than the cantilevered manner.

* * * * *